US007866182B2

(12) United States Patent
Lim et al.

(10) Patent No.: US 7,866,182 B2
(45) Date of Patent: Jan. 11, 2011

(54) REFRIGERATOR

(75) Inventors: Jae Hoon Lim, Suwon-si (KR); Wan Hyeong Lee, Gwangju (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 339 days.

(21) Appl. No.: 12/010,752

(22) Filed: Jan. 29, 2008

(65) Prior Publication Data

US 2008/0202149 A1 Aug. 28, 2008

(30) Foreign Application Priority Data

Feb. 26, 2007 (KR) ..... 10-2007-0019194

(51) Int. Cl.
*F25D 17/04* (2006.01)

(52) U.S. Cl. ..... 62/418; 62/407; 62/411

(58) Field of Classification Search ..... 62/407, 62/411, 418, 419, 440, 441, 443
See application file for complete search history.

(56) References Cited

U.S. PATENT DOCUMENTS

| | | | | | |
|---|---|---|---|---|---|
| 5,664,437 | A * | 9/1997 | Park et al. | ..... | 62/407 |
| 5,687,580 | A * | 11/1997 | Jeong et al. | ..... | 62/186 |
| 5,735,138 | A * | 4/1998 | Park et al. | ..... | 62/455 |
| 5,758,512 | A * | 6/1998 | Peterson et al. | ..... | 62/407 |
| 5,799,500 | A * | 9/1998 | Kang | ..... | 62/408 |
| 6,347,530 | B1 * | 2/2002 | Kim | ..... | 62/407 |
| 6,351,967 | B1 * | 3/2002 | Adachi et al. | ..... | 62/441 |
| 6,550,268 | B2 * | 4/2003 | Lee et al. | ..... | 62/407 |
| 7,484,382 | B2 * | 2/2009 | Kim et al. | ..... | 62/353 |

* cited by examiner

*Primary Examiner*—Melvin Jones
(74) *Attorney, Agent, or Firm*—Staas & Halsey LLP

(57) ABSTRACT

A refrigerator having a cold air supply device is provided. The refrigerator includes an evaporator and the cold air supply device mounted at a rear surface of a storage compartment to cover the evaporator. The cold air supply device includes a plurality of discharge holes formed in a front surface and both lateral surfaces thereof to discharge cold air, which was heat exchanged by the evaporator, toward front and lateral sides of the cold air supply device.

11 Claims, 6 Drawing Sheets

REFRIGERATOR

CROSS-REFERENCE TO RELATED APPLICATIONS

This application claims the benefit of Korean Patent Application No. 2007-0019194, filed on Feb. 26, 2007 in the Korean Intellectual Property Office, the disclosure of which is incorporated herein by reference.

BACKGROUND

1. Field

The present invention relates to a refrigerator, and, more particularly, to a refrigerator having a cold air supply device.

2. Description of the Related Art

In general, a refrigerator includes a freezing compartment and a refrigerating compartment for storing food, etc., cooled by cold air that is introduced into the compartments after being heat exchanged by an evaporator. A machine room having a compressor and a condenser therein is provided in a lower position of a rear surface of the freezing or refrigerating compartment. The refrigerating compartment included in the above described general refrigerator keeps food, etc., fresh at a temperature of approximately 3° C.~5° C., and the freezing compartment freezes food, etc., and keeps the food frozen for a long time at a sub-zero temperature.

One example of a related refrigerator is disclosed in Korean Utility Model Laid-open Publication No. 2000-0006487. The refrigerator disclosed in the above Publication includes cold air supply devices provided in rear regions of freezing and refrigerating compartments to produce and supply cold air into the compartments. The cold air supply device for the refrigerating compartment includes a rectangular evaporator mounted at the center of a rear wall surface of the refrigerating compartment, the evaporator being covered by an insulating member and an evaporator cover. The cold air supply device further comprises suction ducts to suction and guide cold air in the refrigerating compartment to the evaporator and discharge ducts to discharge the cold air, which was heat exchanged by the evaporator, into the refrigerating compartment, the suction ducts and discharge ducts being symmetrically arranged at both sides of the evaporator, respectively. A fan and a motor are provided above the center of the evaporator, to forcibly blow the cold air, which was suctioned into the lower portion of the evaporator through the suction ducts and was heat exchanged by the evaporator, into the refrigerating compartment.

The discharge ducts have upper ends to communicate with an upper portion of the evaporator and lower ends extending symmetrically along both lateral surfaces of the evaporator. Each discharge duct has a plurality of cold air discharge holes arranged in multiple stages. The suction ducts have lower ends communicating with the lower portion of the evaporator and upper ends adjacent to the discharge ducts.

In the cold air supply device for the refrigerating compartment, if cold air is discharged into the refrigerating compartment through the cold air discharge holes arranged in multiple states, the cold air flows upward to the upper region of the refrigerating compartment by natural convection phenomenon after being heat exchanged with air in the refrigerating compartment. As the heat-exchanged air is again introduced into the evaporator through the suction holes and suction ducts, the air is changed into low-temperature cold air for the continuous circulation of the cold air. Accordingly, the cold air can be uniformly distributed throughout the refrigerating compartment through the cold air discharge holes without a separate distributor.

However, the conventional cold air supply device of the refrigerator disclosed in the above Publication cannot supply the cold air into upper corners of the rear surface of the refrigerating compartment since all the cold air discharge holes are formed only in the front surface of the cold air supply device to discharge cold air forward.

In particular, in the case of a general refrigerator having a refrigerating compartment and a freezing compartment divided up and down or so-called French type refrigerator, the conventional cold air supply device could not efficiently supply the cold air toward lateral surfaces of the refrigerating compartment due to a large-size of the refrigerating compartment.

Therefore, there is a need to provide the cold air supply device with flow paths to supply the cold air to the above mentioned regions that have difficulty receiving the cold air. However, this results in a complicated manufacturing process and expensive manufacturing costs.

Furthermore, in the cold air supply device of the refrigerator disclosed in the above Publication, since the discharge ducts are provided along both the lateral surfaces of the evaporator and the suction ducts are provided at the outside of the discharge ducts, the cold air supply device has a large size, and reduces a storage space of the refrigerating compartment.

SUMMARY

Accordingly, it is an aspect of the present invention to provide a refrigerator having a cold air supply device capable of supplying cold air uniformly throughout a storage compartment while maintaining a compact size thereof.

Additional aspects and/or advantages of the present invention will be set forth in part in the description which follows and, in part, will be apparent from the description, or may be learned by practice of the invention.

The foregoing and/or other aspects of the present invention are achieved by providing a refrigerator comprising an evaporator; a storage compartment; and a cold air supply device mounted at a rear surface of the storage compartment to cover the evaporator, the cold air supply device comprising a plurality of discharge holes defined in a front surface thereof and lateral surfaces thereof to discharge cold air, which was heat exchanged by the evaporator respectively, toward front and lateral sides of the cold air supply device.

The cold air supply device may include a suction hole formed in an upper portion thereof to suction the cold air in the storage compartment.

The cold air supply device may include suction flow paths formed in both lateral portions thereof to guide the cold air suctioned through the suction hole to a lower portion of the evaporator.

The plurality of discharge holes may include at least one lateral discharge hole formed in an upper position of either lateral surface of the cold air supply device, and a plurality of front discharge holes formed in the front surface of the cold air supply device.

The cold air supply device may include at least one front discharge flow path formed in a center portion thereof to guide the heat-exchanged cold air to the plurality of front discharge holes.

The front discharge flow path may be located in front of the evaporator, and the suction flow paths may be located at both lateral sides of the evaporator.

The at least one front discharge flow path may include a plurality of front discharge flow paths having different cross sectional areas to allow a uniform amount of the cold air to be discharged to the plurality of front discharge holes.

The cold air supply device may include a blower, and the discharge hole formed in the front surface of the cold air supply device is located in front of the blower.

The foregoing and/or aspects of the present invention can be achieved by providing a refrigerator including: a body defining a storage compartment formed therein; a door to open or close the storage compartment; an evaporator provided in the body; a cold air supply device mounted at a rear surface of the storage compartment to cover the evaporator and having a plurality of cold air flow paths formed therein; a plurality of suction holes formed in an upper portion of the cold air supply device; and a plurality of discharge holes formed in the cold air supply device to discharge cold air to the door and both lateral surfaces of the storage compartment.

The suction holes may be symmetrically arranged at both lateral surfaces of the cold air supply device.

The plurality of discharge holes may include at least one front discharge hole formed in a front surface of the cold air supply device and lateral discharge holes formed in both lateral surfaces of the cold air supply device.

The cold air flow paths may include suction flow paths to communicate the suction holes with a lower portion of the evaporator, lateral discharge flow paths to communicate the lateral discharge holes with an upper portion of the evaporator, and at least one front discharge flow path to communicate the front discharge hole with the upper portion of the evaporator.

The front discharge flow path may be located in front of the evaporator, and the suction flow path is located in both lateral sides of the evaporator.

The storage compartment may include a dented portion defined in an inner shell thereof, and the evaporator is embedded in the dented portion.

The foregoing and/or other aspects can be achieved by providing a refrigerator including: a body defining a plurality of storage compartments spaced relative to each other in a vertical direction; a plurality of doors to open or close the plurality of storage compartments, respectively; an evaporator provided in the body; a cold air supply device mounted at a predetermined region of a rear surface of the corresponding storage compartment to cover the evaporator; and a plurality of discharge holes formed in a front surface and lateral surfaces of the cold air supply device to supply cold air, which was heat exchanged by the evaporator, into the storage compartment.

BRIEF DESCRIPTION OF THE DRAWINGS

These and/or other aspects and advantages of the exemplary embodiments of the invention will become apparent and more readily appreciated from the following description of the embodiments, taken in conjunction with the accompanying drawings, of which.

DETAILED DESCRIPTION OF THE EMBODIMENT

Figure 1:
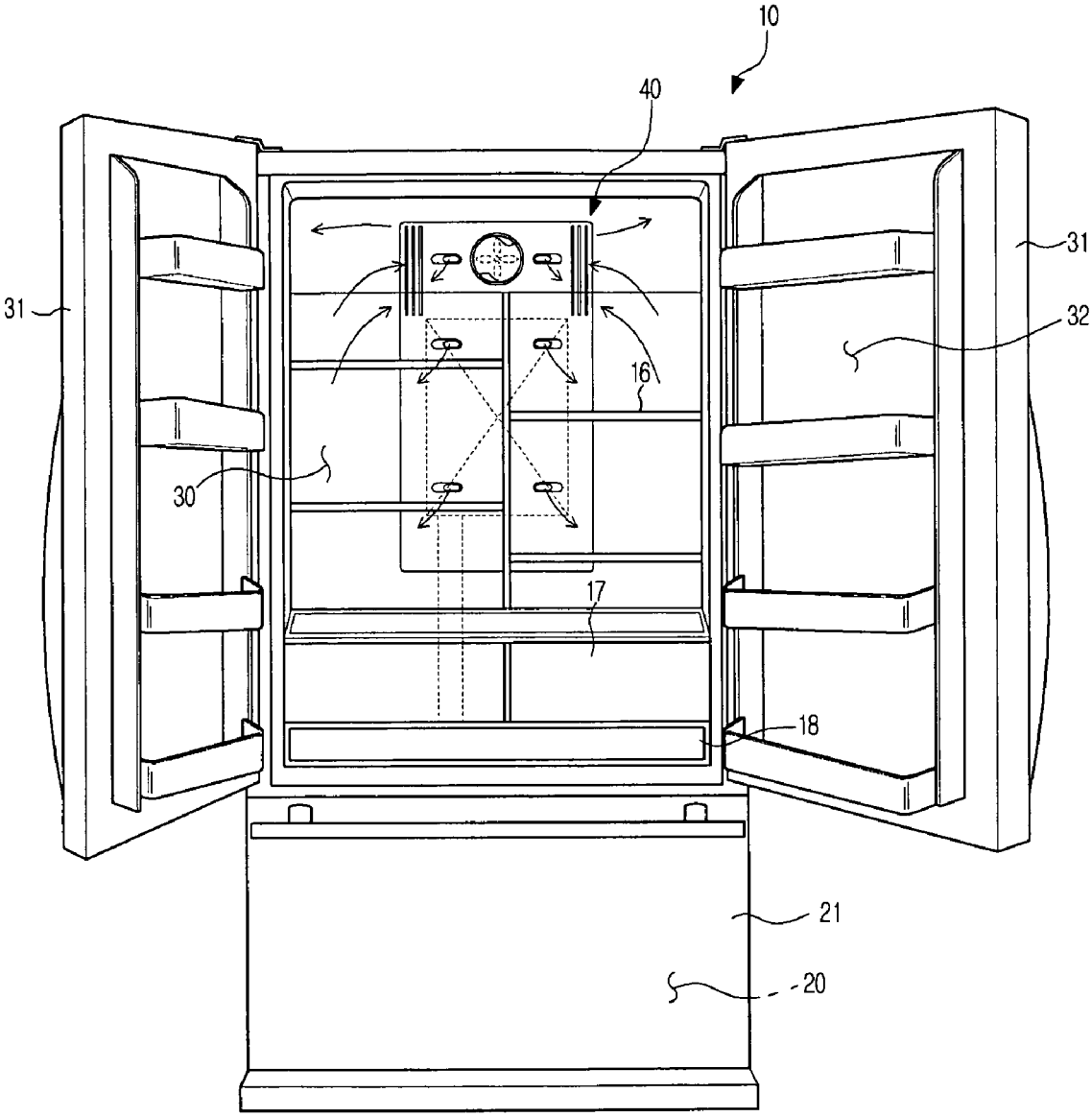
FIG. 1 is a perspective view showing the outer appearance of a refrigerator according to an exemplary embodiment of the present invention, in a state wherein refrigerating compartment doors are opened.

Reference will now be made in detail to the embodiment, an example of which is illustrated in the accompanying drawings, wherein like reference numerals refer to the like elements throughout. The embodiment is described below to explain the present invention by referring to the figures.

Hereinafter, an embodiment of the present invention relates to a so-called "French" type refrigerator, in which a refrigerating compartment and a freezing compartment are arranged above and below each other and the refrigerating compartment has a pair of doors installed at a front surface thereof, will be described in detail with reference to the drawings.

Figure 2:
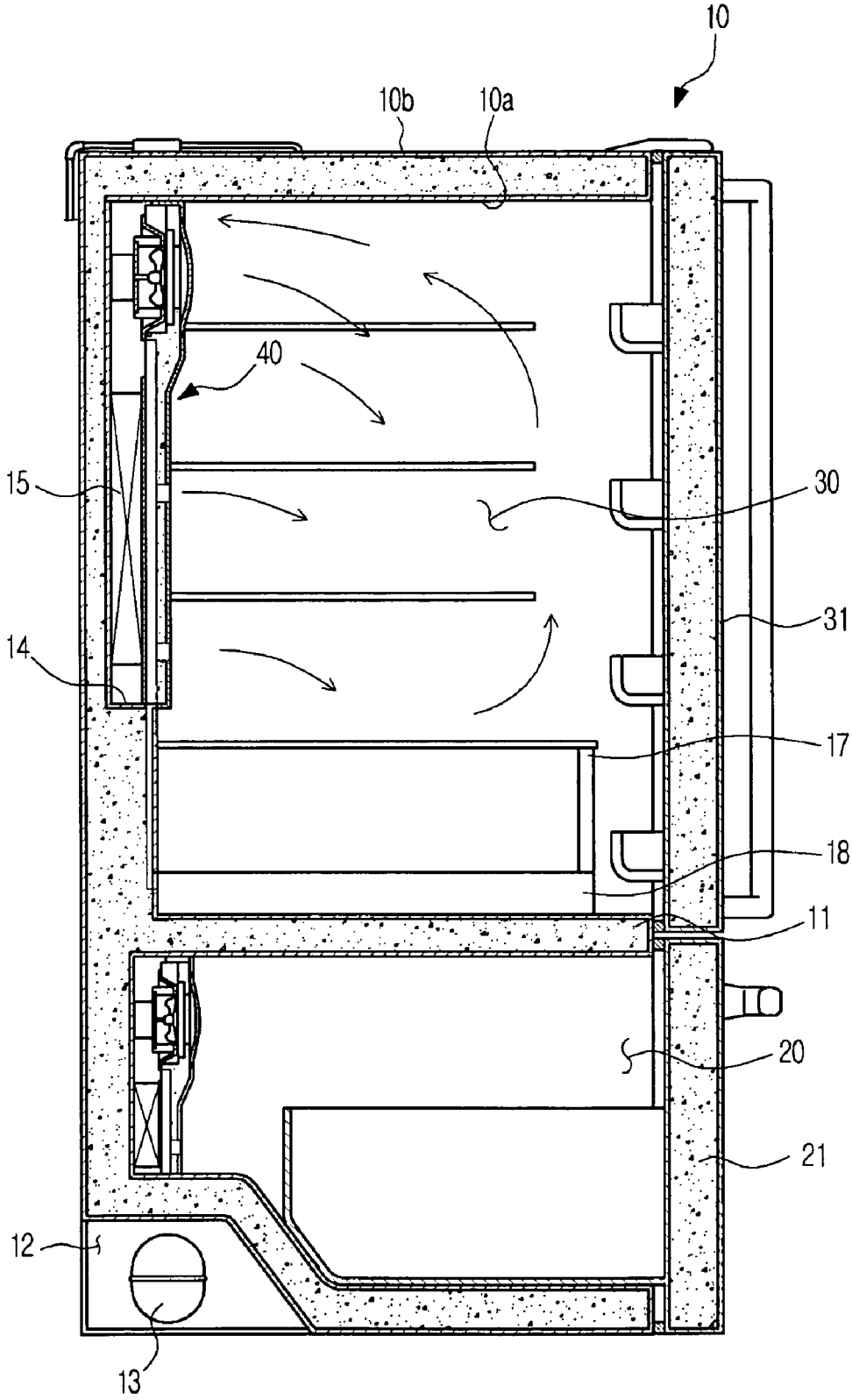
FIG. 2 is a side sectional view showing the closed state of the refrigerating compartment doors of FIG. 1.

FIG. 1 is a perspective view showing the opened state of the refrigerating compartment doors included in the refrigerator according to the exemplary embodiment of the present invention. FIG. 2 is a side sectional view showing the closed state of the refrigerating compartment doors.

The refrigerator according to the embodiment of the present invention, as shown in FIGS. 1 and 2, includes a body 10 having a plurality of storage compartments 20 and 30 divided up and down by a horizontal insulating partition 11, doors 21 and 31 provided at front surfaces of the storage compartments 20 and 30 to open or close the storage compartments 20 and 30, and cold air supply devices 40 installed in the respective storage compartments 20 and 30 to supply cold air into the storage compartments 20 and 30.

It will be appreciated that the refrigerator according to the embodiment of the present invention includes refrigeration cycle elements, for example, a compressor 13, a condenser (not shown), and an evaporator 15.

The body 10 has a machine room 12 defined in a lower rear region thereof. The machine room 12 receives electric elements such as the compressor 13, etc. An insulating foam material is filled between an inner shell 10*a* and an outer shell 10*b* of the body 10.

The storage compartments 20 and 30 are located above the machine room 12. The storage compartment 30 located above the insulating partition 11 serves as a refrigerating compartment, and the storage compartment 20 located below the insulating partition 11 serves as a freezing compartment.

The freezing compartment 20 has a sliding type freezing compartment door 21 installed at a front surface thereof. The refrigerating compartment 30 has a pair of refrigerating compartment doors 31 installed at a front surface thereof, the refrigerating compartment doors 31 being hingedly coupled to opposite side edges of the body 10 to be pivotally rotated. Each refrigerating compartment door 31 has receiving spaces 32 defined in an inner surface thereof.

The refrigerating compartment 30 defined in the upper region of the body 10 includes an evaporator 15 mounted to a rear surface of the refrigerating compartment 30 to produce cold air to be supplied into the refrigerating compartment 30, shelves 16 and receiving drawers 17 to receive food, etc., which are kept cool, and the cold air supply device 40 configured to cover the evaporator 15 so as to supply the cold air, which was heat exchanged by the evaporator 15, into the refrigerating compartment 30.

The refrigerating compartment 30 has a rearwardly dented mounting portion 14 formed in the inner rear surface thereof such that the evaporator 15 is seated in the mounting portion 14. The cold air supply device 40 has a larger area than that of the evaporator 15 to cover the evaporator 15.

With the above described configuration, as a result of fixedly seating the evaporator 15 in the mounting portion 14, it is possible to substantially prevent the evaporator 15 from protruding into the refrigerating compartment 30.

The plurality of shelves 16 provided in the refrigerating compartment 30 are adjustable in height, and a pair of the receiving drawers 17 are provided on the underside of the lowermost shelf. In turn, a pantry 18 is provided on the underside of the pair of receiving drawers 17 to store relatively large groceries.

Figure 3:
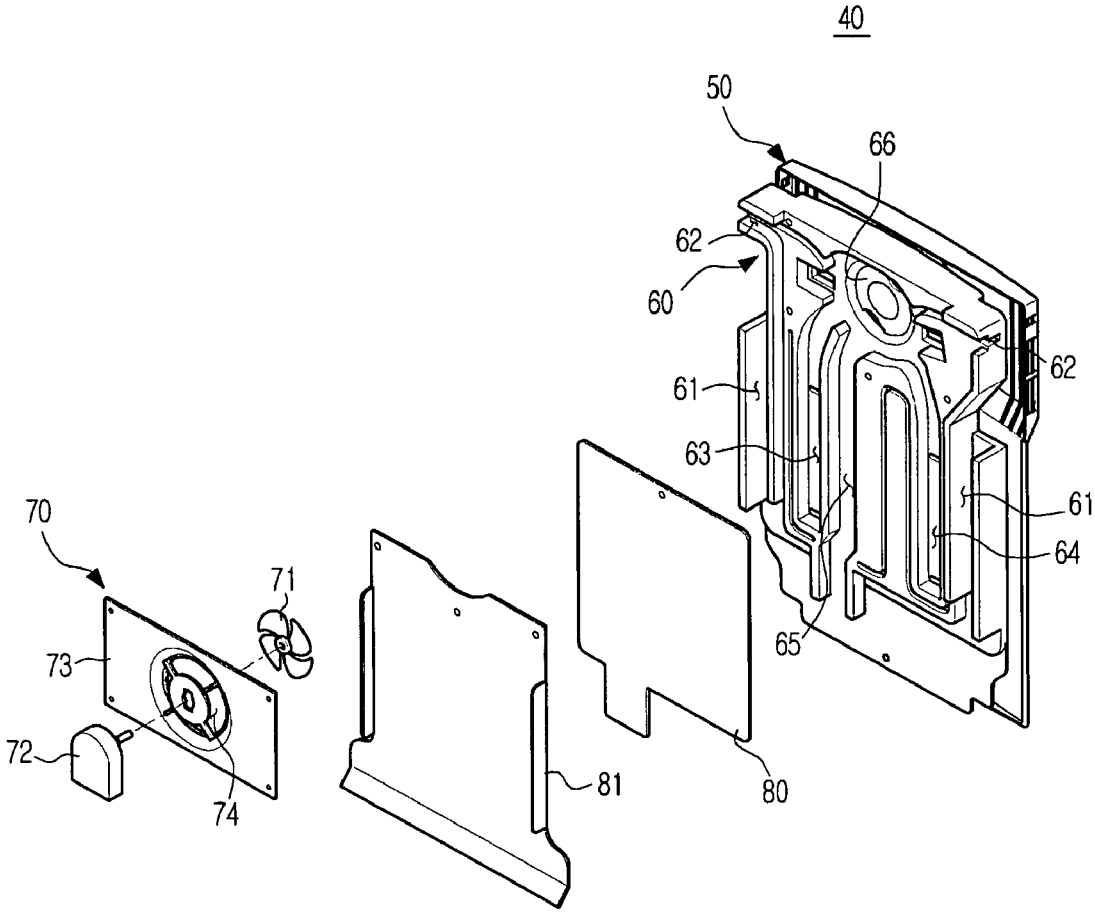
FIG. 3 is an exploded perspective view of a cold air supply device included in the refrigerator according to the embodiment of the present invention.

FIG. 3 is an exploded perspective view of the cold air supply device included in the refrigerator according to the embodiment of the present invention.

The cold air supply device 40 to supply cold air into the refrigerating compartment 30, as shown in FIG. 3, includes a cover 50, a cold air duct 60 coupled to the cover 50 and having flow paths defined therein, a blower 70 to forcibly circulate the cold air, and an insulating member 80 mounted to a rear surface of the cold air supply device 40 to separate the evaporator 15 from the cold air duct 60.

Figure 4:
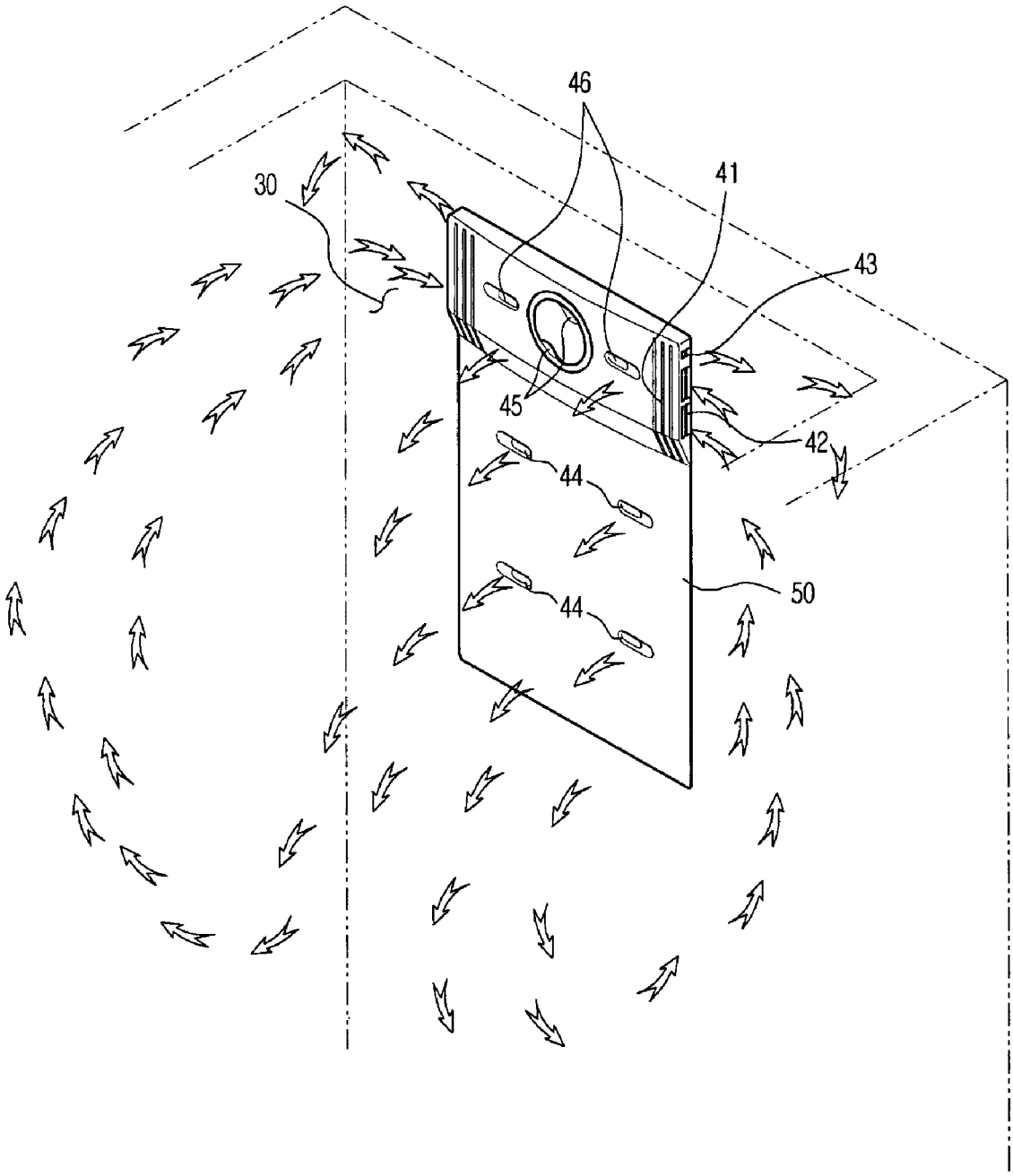
FIG. 4 is a perspective view showing parts of a refrigerating compartment installed with the cold air supply device included in the refrigerator according to the embodiment of the present invention.
Figure 5:
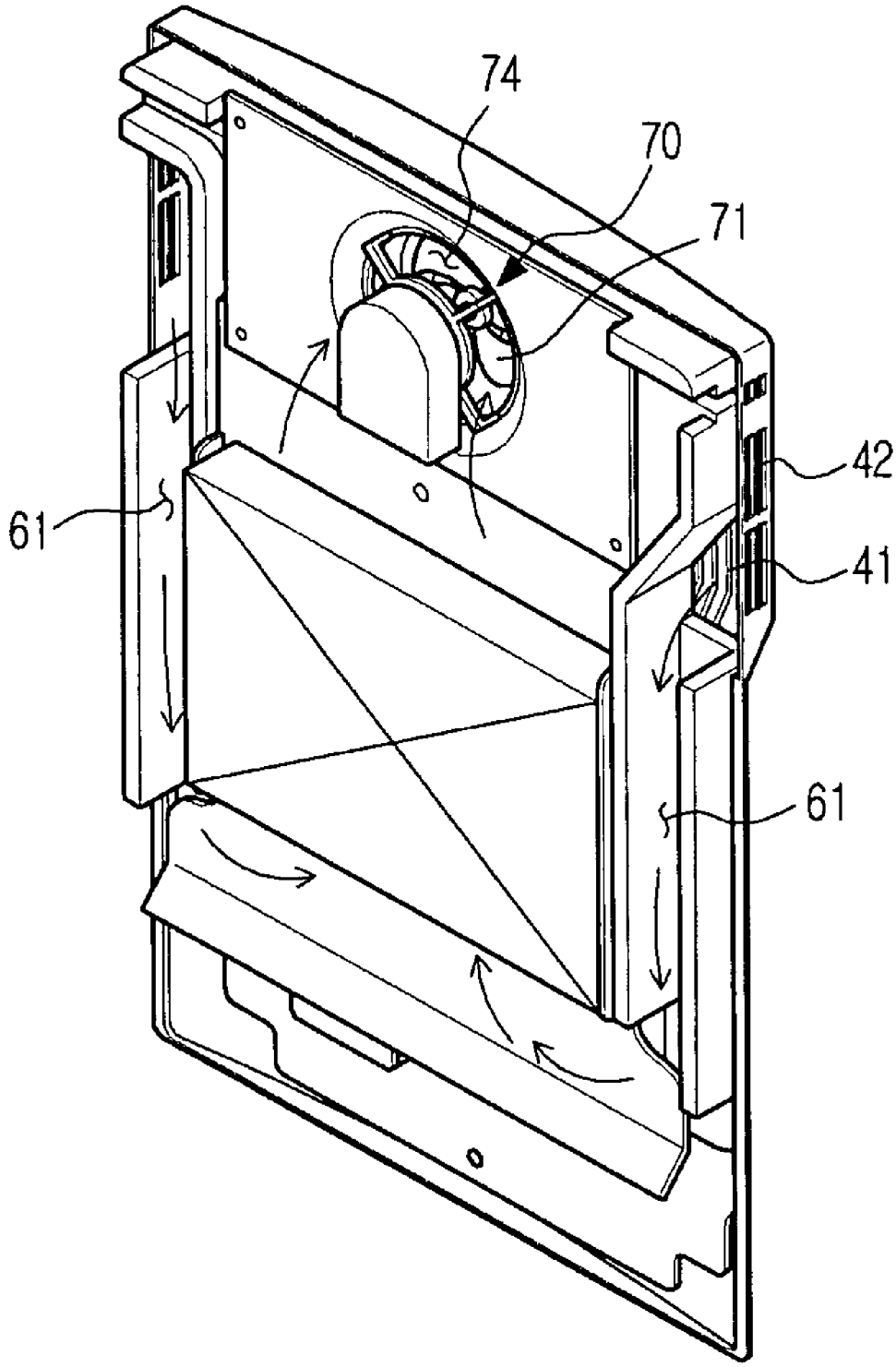
FIG. 5 is a rear perspective view of the cold air supply device included in the refrigerator according to the embodiment of the present invention.

The cover 50, as shown in FIG. 4, has a rectangular shape, and also has a centrally protruding streamline cross sectional shape. The cover 50 is perforated in the front surface and both lateral surfaces thereof with suction holes 41 and 42 and discharge holes 43, 44, 45, and 46.

The suction holes 41 and 42 to suction cold air in the refrigerating compartment 30 include a pair of first suction holes 41 symmetrically perforated in opposite upper corners of the front surface of the cover 50, and a pair of second suction holes 42 perforated in upper positions of both of the lateral surfaces of the cover 50 at approximately the same height as that of the first suction holes 41.

The discharge holes to discharge the heat-exchanged cold air into the refrigerating compartment 30 include a pair of lateral discharge holes 43 perforated above the respective second suction holes 42 to discharge the cold air to both lateral surfaces of the refrigerating compartment 30, and a plurality of front discharge holes 44 perforated in the front surface of the cover 50 to be vertically spaced apart from one another by a predetermined distance so as to discharge cold air toward the front surface of the refrigerating compartment 30.

The size of the lateral discharge holes 43 is determined experimentally, and has a predetermined small value suitable not only to prevent the cold air, discharged from the lateral discharge holes 43, from being directly suctioned into the first and second suction holes 41 and 42, but also to discharge the cold air to a distance toward upper corners of the refrigerating compartment 30, in order to supply the cold air to these areas.

The discharge holes further include front wave-shaped discharge holes 45 perforated in the upper center of the cover 50 to guide the cold air, blown by the blower 70, into the refrigerating compartment 30 rather than guiding the cold air to pass through discharge flow paths 62, 63, 64, and 65 (described hereinafter), and upper discharge holes 46 perforated at opposite sides of the front wave-shaped discharge holes 45.

The cold air duct 60 located inside the cover 50, as shown in FIG. 3, has flow paths to guide the cold air, suctioned through the suction holes 41 and 42, to the evaporator 15, and also to guide the cold air, which was heat exchanged by the evaporator 15, to the lateral and front discharge holes 43 and 44.

The flow paths include suction flow paths 61 each having one side to communicate with the corresponding first and second suction holes 41 and 42 and the other side extending downward to communicate with a lower portion of the evaporator 15, and discharge flow paths 62, 63, and 64 to guide the heat-exchanged cold air to the lateral discharge holes 43 and the front discharge holes 44, each discharge flow path having one side to communicate with an upper portion of the evaporator 15 and the other side to communicate with the corresponding lateral and front discharge holes 43 and 44.

Also, the cold air duct 60 has a circular fixing portion 66 formed in the upper portion thereof to mount the blower 70 therein. One side of the front surface of the fixing portion 66 is opened to guide the cold air to the front wave-shaped discharge holes 45 and the upper discharge holes 46.

Specifically, the discharge flow paths 62, 63, and 64 to discharge the cold air to the lateral discharge holes 43 and the front discharge holes 44 include a pair of lateral discharge flow paths 62 to communicate the upper portion of the evaporator 15 with the pair of lateral discharge holes 43, respectively, and the front discharge flow paths 63 and 64 to communicate the upper portion of the evaporator 15 with the plurality of front discharge holes 44.

More specifically, the front discharge flow paths 63 and 64 include a first front discharge flow path 63 to communicate the plurality of front discharge holes 44, which are vertically formed in the left side of FIG. 4, with the upper portion of the evaporator 15, and a second front discharge flow path 64 to communicate the plurality of first discharge holes 44, which are vertically formed in the right side of FIG. 4, with the upper portion of the evaporator 15. In addition, there is provided a pantry discharge flow path 65 to provide the cold air into the pantry 18 provided in the lower region of the refrigerating compartment 30.

The blower 70 to forcibly circulate the cold air is provided above the evaporator 15. The blower 70 includes a blowing fan 71, a drive motor 72 to provide the blowing fan 71 with a drive force, and a bell-mouth 74 formed in a plate 73 to fix the drive motor 72 therein.

With the above described flow paths, if the cold air is suctioned into the first and second suction holes 41 and 42, the cold air is guided to the lower portion of the evaporator 15 through the suction flow paths 61, so as to be heat exchanged by the evaporator 15. The heat-exchanged cold air is guided to the discharge holes by passing through the bell-mouth 74 of the blower 70. In this case, since the blowing fan 71 is an axial-flow fan, the amount of cold air to be introduced into the respective discharge flow paths 62, 63, and 64 is changed according to a rotating direction of the blowing fan 71. Therefore, the discharge flow paths 62, 63, and 64 have different cross sectional areas from one another to supply the cold air uniformly into the respective discharge flow paths 62, 63, and 64. In the embodiment of the present invention as shown in FIG. 3, since the blowing fan 71 is provided to rotate clockwise, the amount of cold air supplied into the second front discharge flow path 64 is larger than the amount of cold air supplied into the first front discharge flow path 63. Therefore, the first front discharge flow path 63 must have a larger cross sectional area than that of the second front discharge flow path 64, to assure a uniform amount of cold air to flow through the first and second front discharge flow paths 63 and 64.

The insulating member 80 is provided between the evaporator 15 and the front discharge flow paths 63 and 64, to separate the evaporator 15 from the front discharge flow paths 63 and 64. The insulating member 80 has a barrier plate 81 fixed thereto to prevent water, generated during defrosting of the evaporator 15, from permeating into the insulating member 80 and to guide the water into a drain pan (not shown) provided below the insulating member 80.

The cold air supply device 40 having the above described configuration is mounted to cover the evaporator 15 provided at the rear surface of the refrigerating compartment 30. In this case, an upper end of the cold air supply device 40 is located adjacent to an inner top surface of the refrigerating compartment 30 such that the cold air discharged from the lateral discharge holes 43 at both the lateral surfaces of the cold air supply device 40 can reach inner upper corners of the refrigerating compartment 30. This assures uniform distribution of the heat-exchanged cold air throughout the refrigerating compartment 30 (See FIG. 4).

The cold air supply device included in the embodiment of the present invention can also be installed in the freezing compartment as well as the refrigerating compartment. The description of the cold air supply device for the freezing compartment is omitted herein.

Hereinafter, the circulation of cold air in the refrigerating compartment of the refrigerator according to the embodiment of the present invention will be described.

Figure 6:
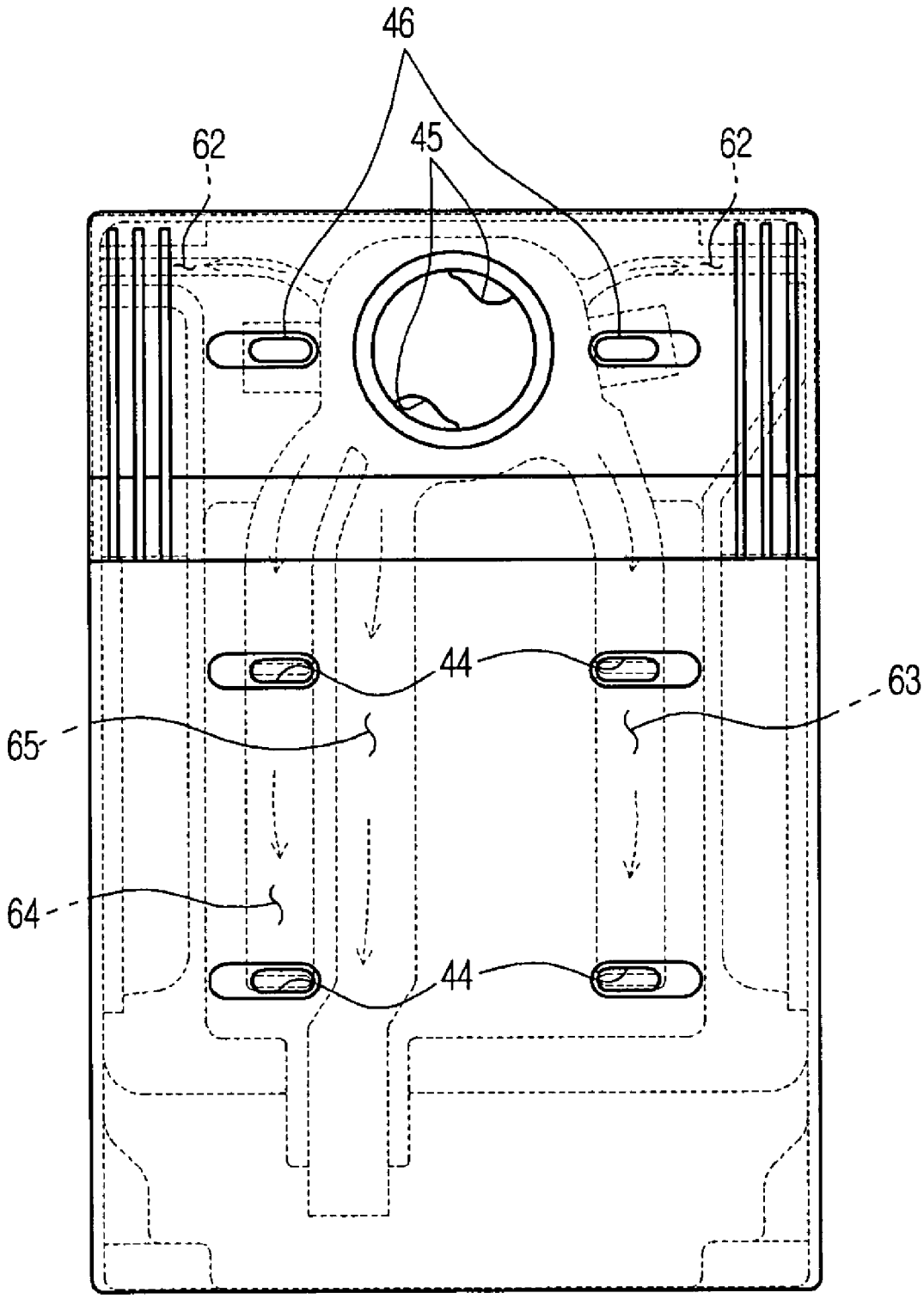
FIG. 6 is a front view of the cold air supply device included in the refrigerator according to the embodiment of the present invention.

As shown in FIG. 6, if the blower 70 is driven, the cold air inside the refrigerating compartment 30 is introduced into the first and second suction holes 41 and 42 provided at both the upper corners of the cover 50. The introduced cold air is guided to the lower portion of the evaporator 15 through the pair of suction flow paths 61 that are longitudinally formed in both the lateral surfaces of the cold air supply device 40. After being heat exchanged by the evaporator 15, the cold air is guided to the blowing fan 71 located above the evaporator 15, thereby being discharged forward through the bell-mouth 74.

The cold air discharged from the cold air supply device 40, as shown in FIG. 6, is partially supplied to the upper front region of the refrigerating compartment 30 through the front discharge holes 45 and the upper discharge holes 46, and is partially supplied to the upper corners of the refrigerating compartment 30 through the lateral discharge holes 43 by flowing along the lateral discharge flow paths 62 formed at the upper portions of both the lateral surfaces of the cold air duct 60, and is also partially supplied to an opening of the refrigerating compartment 30 through the front discharge holes 44 by flowing along the front discharge flow paths 63 and 64. Also, the remaining cold air is guided into the pantry 18 provided in the lower region of the refrigerating compartment 30 through the pantry discharge flow path 65.

The above described cold air supply device 40 can supply cold air uniformly throughout the refrigerating compartment 30 by virtue of the discharge holes 43, 44, 45, and 46 provided at various positions and directions. Also, the cold air supply device 40 can achieve a compact configuration as a result that the front discharge flow paths 63 and 64 are provided in front of the evaporator 15 and the suction flow paths 61 are provided at both the lateral sides of the evaporator 15.

It will be appreciated that the cold air supply device of the refrigerator according to the embodiment of the present invention is applicable to various types of refrigerators, such as a bottom freezer type refrigerator having an upper refrigerating compartment and a lower freezing compartment, a top freezer type refrigerator having an upper freezing compartment and a lower refrigerating compartment, and a side-by-side type refrigerator having a left or right refrigerating compartment and a right or left freezing compartment, as well as the French type refrigerator according to the embodiment of the present invention.

As apparent from the above description, in the cold air supply device according to the embodiment of the present invention, the cold air suction holes are formed in both upper lateral surfaces of the cold air supply device and discharge holes are formed in the front surface as well as both the upper lateral surfaces of the cold air supply device, so as to assure that the cold air is supplied uniformly into the refrigerating compartment after being heat exchanged by an evaporator. With the uniform supply of the cold air, a temperature deviation in the refrigerating compartment is reduced.

Further, according to the embodiment of the present invention, the cold air suction flow paths are formed at both lateral surfaces of the cold air supply device and the discharge flow paths are formed in front of the evaporator and formed inside the suction flow paths, resulting in a compact configuration of the cold air supply device.

Although an embodiment of the present invention has been shown and described, it would be appreciated by those skilled in the art that changes may be made in this embodiment without departing from the principles and spirit of the invention, the scope of which is defined in the claims and their equivalents.

What is claimed is:

1. A refrigerator comprising:

an evaporator;

a storage compartment; and a cold air supply device mounted at a rear surface of the storage compartment to cover the evaporator, the cold air supply device comprising:

a plurality of discharge holes defined in a front surface thereof and lateral surfaces thereof to discharge cold air, which was heat exchanged by the evaporator respectively, toward front and lateral sides of the cold air supply device, wherein the cold air supply device further comprises a suction hole formed in an upper portion thereof to suction the cold air in the storage compartment, the cold air supply device further comprises suction flow paths formed in the lateral portions thereof to guide the cold air suctioned through the suction hole to a lower portion of the evaporator and the plurality of discharge holes comprise at least one lateral discharge hole formed in an upper position of one of the lateral surfaces, and a plurality of front discharge holes formed in the front surface.

2. The refrigerator according to claim 1, wherein the cold air supply device comprises at least one front discharge flow path formed in a center portion thereof to guide the heat-exchanged cold air to the plurality of front discharge holes.

3. The refrigerator according to claim 2, wherein the front discharge flow path is located in front of the evaporator, and the suction flow paths are located at both lateral sides of the evaporator.

4. The refrigerator according to claim 2, wherein the at least one front discharge flow path comprises a plurality of front discharge flow paths having different cross sectional areas to allow a uniform amount of the cold air to be discharged to the plurality of front discharge holes.

5. The refrigerator according to claim 1, wherein the cold air supply device further comprises a blower, and the discharge hole formed in the front surface of the cold air supply device is located in front of the blower.

6. A refrigerator comprising:

a body defining a storage compartment therein;

a door to open or close the storage compartment;

an evaporator provided in the body;

a cold air supply device mounted at a rear surface of the storage compartment to cover the evaporator and having a plurality of cold air flow paths formed therein;

a plurality of suction holes formed in an upper portion of the cold air supply device; and a plurality of discharge holes formed in the cold air supply device to discharge cold air to the door and lateral surfaces of the storage compartment, wherein the plurality of discharge holes comprise a front discharge hole formed in a front surface of the cold air supply device and a plurality of lateral discharge holes formed at lateral surfaces of the cold air supply device, and wherein the storage compartment comprises a dented portion defined in an inner shell thereof, and the evaporator is embedded in the dented portion.

7. The refrigerator according to claim 6, wherein the suction holes are symmetrically arranged at lateral surfaces of the cold air supply device.

8. The refrigerator according to claim 6, wherein the cold air flow paths comprise a plurality of suction flow paths to communicate the suction holes with a lower portion of the evaporator, lateral discharge flow paths to communicate the lateral discharge holes with an upper portion of the evaporator, and a front discharge flow path to communicate the front discharge hole with the upper portion of the evaporator.

9. The refrigerator according to claim 8, wherein the front discharge flow path is located in front of the evaporator, and the suction flow path is located lateral sides of the evaporator.

10. A refrigerator comprising:

a body having a plurality of storage compartments spaced relative to each other in a vertical direction;

a plurality of doors to open or close the plurality of storage compartments, respectively;

an evaporator provided in the body;

a cold air supply device mounted at a predetermined region of a rear surface of the corresponding storage compartment to cover the evaporator and having a plurality of clod air flow paths formed therein;

a plurality of suction holes formed in an upper portion of the cold air supply device; and a plurality of discharge holes formed in a front surface and lateral surfaces of the cold air supply device to supply cold air, which was heat exchanged by the evaporator, into the storage compartment, wherein the plurality of discharge holes comprise a front discharge hole formed in a front surface of the cold air supply device and a plurality of lateral discharge holes formed at the lateral surfaces of the cold air supply device, the cold air flow paths comprise a plurality of suction flow paths to communicate the suction holes with a lower portion of the evaporator, lateral discharge flow paths to communicate the lateral discharge holes with an upper portion of the evaporator, and a front discharge flow path to communicate the front discharge hole with the upper portion of the evaporator, and wherein one of the storage compartments comprises a dented portion defined in an inner shell thereof, and the evaporator is embedded in the dented portion.

11. A refrigerator comprising:

a body defining a refrigerating storage compartment and a freezing compartment arranged at an upper portion and a lower portion of the body, the refrigerating compartment having a pair of doors installed at a front surface of the body, the freezing compartment having a supply device, respectively, to supply cold air into the refrigerating storage compartment, wherein the refrigerating storage compartment comprises a dented portion defined in an inner shell thereof, and an evaporator embedded in the dented portion.

* * * * *

UNITED STATES PATENT AND TRADEMARK OFFICE

CERTIFICATE OF CORRECTION

PATENT NO. : 7,866,182 B2
APPLICATION NO. : 12/010752
DATED : January 11, 2011
INVENTOR(S) : Jae Hoon Lim et al.

It is certified that error appears in the above-identified patent and that said Letters Patent is hereby corrected as shown below:

Column 10, Line 5, In Claim 10, delete “clod” and insert --cold--, therefor.

Signed and Sealed this
Nineteenth Day of April, 2011

David J. Kappos

David J. Kappos
*Director of the United States Patent and Trademark Office*